United States Patent [19]

Shatto, Jr. et al.

[11] 4,367,909

[45] Jan. 11, 1983

[54] RIBBON CABLE CONNECTOR

[75] Inventors: Walter C. Shatto, Jr., Harrisburg, Pa.; Walter M. Young, Largo, Fla.

[73] Assignee: AMP Incorporated, Harrisburg, Pa.

[21] Appl. No.: 197,049

[22] Filed: Oct. 15, 1980

Related U.S. Application Data

[63] Continuation of Ser. No. 28,952, Apr. 11, 1979, abandoned.

[51] Int. Cl.[3] ..... H01R 13/00

[52] U.S. Cl. ..... 339/176 MF; 339/14 R

[58] Field of Search ..... 339/14 R, 17 F, 99 R, 339/102 R, 103 R, 103 M, 107, 176 M, 176 MF

[56] References Cited

U.S. PATENT DOCUMENTS

| | | | |
|---|---|---|---|
| 3,550,066 | 12/1970 | Cootes | 339/107 |
| 3,569,900 | 3/1971 | Uberbacker | 339/107 |
| 3,768,067 | 10/1973 | Rault | 339/99 R |
| 3,926,498 | 12/1975 | Hoppe, Jr. | 339/103 R |
| 3,936,933 | 2/1976 | Folk et al. | 29/628 |
| 4,076,365 | 2/1978 | Ross et al. | 339/107 |
| 4,080,038 | 3/1978 | Latta et al. | 339/107 |
| 4,094,566 | 6/1978 | Dola et al. | 339/14 R |
| 4,097,106 | 6/1978 | Over et al. | 339/99 R |

*Primary Examiner*—Joseph H. McGlynn
*Attorney, Agent, or Firm*—F. Brice Faller

[57] ABSTRACT

A connector for terminating flat multiconductor cable has a plurality of funnel entries at one end thereof which communicate with grooves in oppositely facing sidewalls of the connector to guide the conductors in the cable to new centerlines for termination to slotted plate ground and signal terminals located in rows of cavities in each of the sidewalls. Signal terminals are located at the opposite end of the connector and ground conductors are located on a common bus spaced between the ends.

5 Claims, 21 Drawing Figures

Fig. 4A
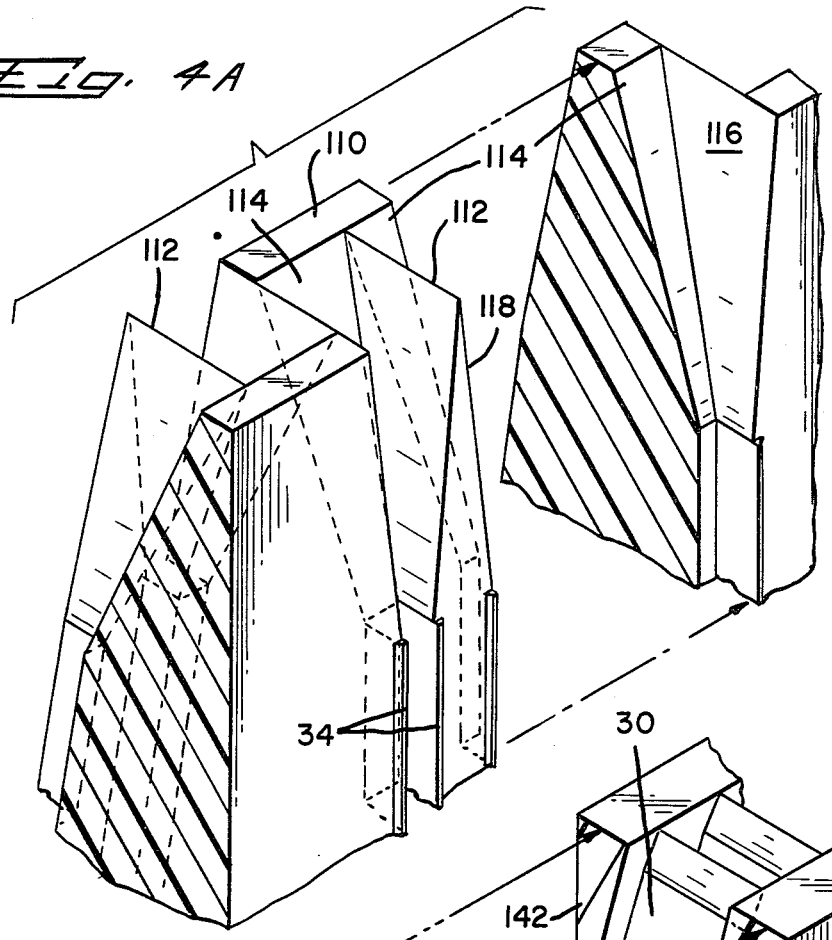
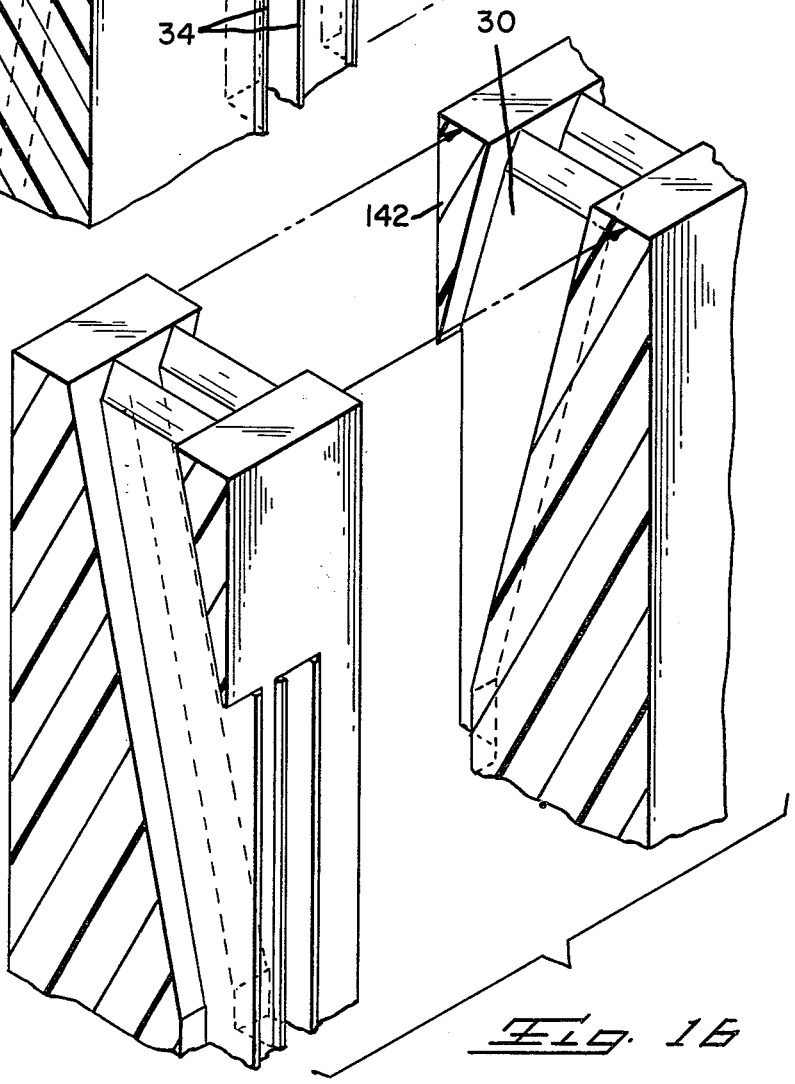
Fig. 16

RIBBON CABLE CONNECTOR

BACKGROUND OF THE INVENTION

This application is a continuation of U.S. application Ser. No. 28,952 filed Apr. 11, 1979, now abandoned.

This invention relates to multi-contact electrical connectors of the type which are intended for installation on a flat conductor cable and which serve to connect the conductors of the cable to terminal posts of other complementary terminal devices. The embodiment of the invention disclosed herein is particularly intended for connecting the conductors of a flat cable to terminal posts on a panel board of the type used in the telephone industry and the description of the invention set forth below makes specific reference to panel boards of this type. However, it will be apparent that the principles of the invention can be used under a wide variety of circumstances and for many other applications.

It is common practice in the telephone industry to form interconnections among large numbers of conductors by means of panel boards having terminal posts extending therefrom on a grid pattern. Connections between individual posts on the panel board are made by discrete wires which have their ends connected to preselected posts. It is also necessary to connect the conductors in individual cables which extend from some remote location to the terminal posts on the panel board. It is now accepted practice to use electrical connectors for these cable-to-post connections and connectors are designed such that the connectors can be mated with the upper free end portions of the posts and above the discrete wire connections which are provided on the lower portions of the posts adjacent to the surface of the panel board. The posts are relatively small, for example, square posts having a width of 0.025 inch are commonly used with the spacing between adjacent posts being 0.125 inch.

The cables are also quite small and have the wires on closely spaced centers of about 0.03 inch with each cable having twenty-four or more conductors therein. It will be realized that the dimensions of the cable and the spacing of the posts precludes the use of most conventional types of multi-contact electrical connectors. One specialized connector which is presently used for these cable-to-post connections comprises a housing having a small printed circuit board, usually referred to as a paddleboard, integral therewith. The conductors on the printed circuit board extend to the terminals in the connector and the conductors in the cable are connected to the conductors on the paddleboard by soldering. This system achieves the dimensional and performance requirements of cable-to-terminal post connections but it is relatively expensive and the installation of a paddleboard connector on the end of a cable is a time consuming and tedious procedure. Furthermore, different types of cables (as regards total number of conductors and the number of signal and ground conductors in the cable) are used and many different wiring patterns of the conductors of the cable and the terminal posts are required. Paddleboard connectors can be designed to accommodate these various requirements but again, the installation costs are relatively high and the system is not amenable to the high production rates which would be desirable.

U.S. Pat. No. 4,094,566 represents a major advancement over pre-existing technology insofar as it teaches use of wire-in-slot type terminals in a connector housing to achieve the dimensional and performance requirements of cable-to-post connections. In a two row housing, terminals set in cavities in either sidewall of the housing receive wires upon moving the wires laterally of their axes into the slots, which protrude above the surface of the sidewall. A ground bus is also provided on the housing which also has wire receiving slots thereon for receiving ground conductors, providing a variety of options regarding which conductors are connected to signal terminals and which are connected to ground. The assembly further comprises housing cover means dimensioned to be assembled to the housing and having conductor guide grooves therein for modifying the centerline spacing of the conductors for reception in wire receiving slots. Assembly involves pre-splitting the conductors in the flat cable by means of interdigitating fingers so that the conductors may be positioned in the grooves in the covers, rolling the conductors into the grooves in the covers, and fitting the covers against the housing to terminate the conductors.

The instant invention is similar to U.S. Pat. No. 4,094,566 insofar as it utilizes wire-in-slot terminals and a ground bus set in opposing sidewalls, but is structurally improved to use one essential workpiece and enables much a simpler assembly procedure. The essential piece is a dielectric body with guide grooves in the opposing sidewalls which modify the centerline spacing as conductors are rolled or wiped into an interference fit in the grooves, which action also positions the conductors for termination in slots in terminals which lie below the surface of the sidewall and in line with the guide grooves. A single array of funnel entries are provided at the conductor receiving end of the dielectric body which direct the individual conductors of a flat cable to the grooves in the opposing sidewalls. This eliminates the step of pre-directing the conductors from the planar array of the cable, and enables a much more simplified cable application, whether manual or automated.

It is thus an object of this invention to provide a connector having conductor relocation means and conductor termination means in a single workpiece.

It is a further object of this invention to provide a connector capable of directing ground and signal conductors of a flat cable to predetermined faces of a connector without pre-arranging the conductors from the original planar array.

Other objects and their achievement will be apparent to one skilled in the art from the drawings and written description which follow.

BRIEF DESCRIPTION OF THE DRAWINGS

FIG. 4A is a fragmentary view of the top of the connector body.

FIG. 16 is a fragmentary perspective view of the squared funnel entry of an alternative embodiment.

DESCRIPTION OF THE PREFERRED EMBODIMENT

Figure 1:
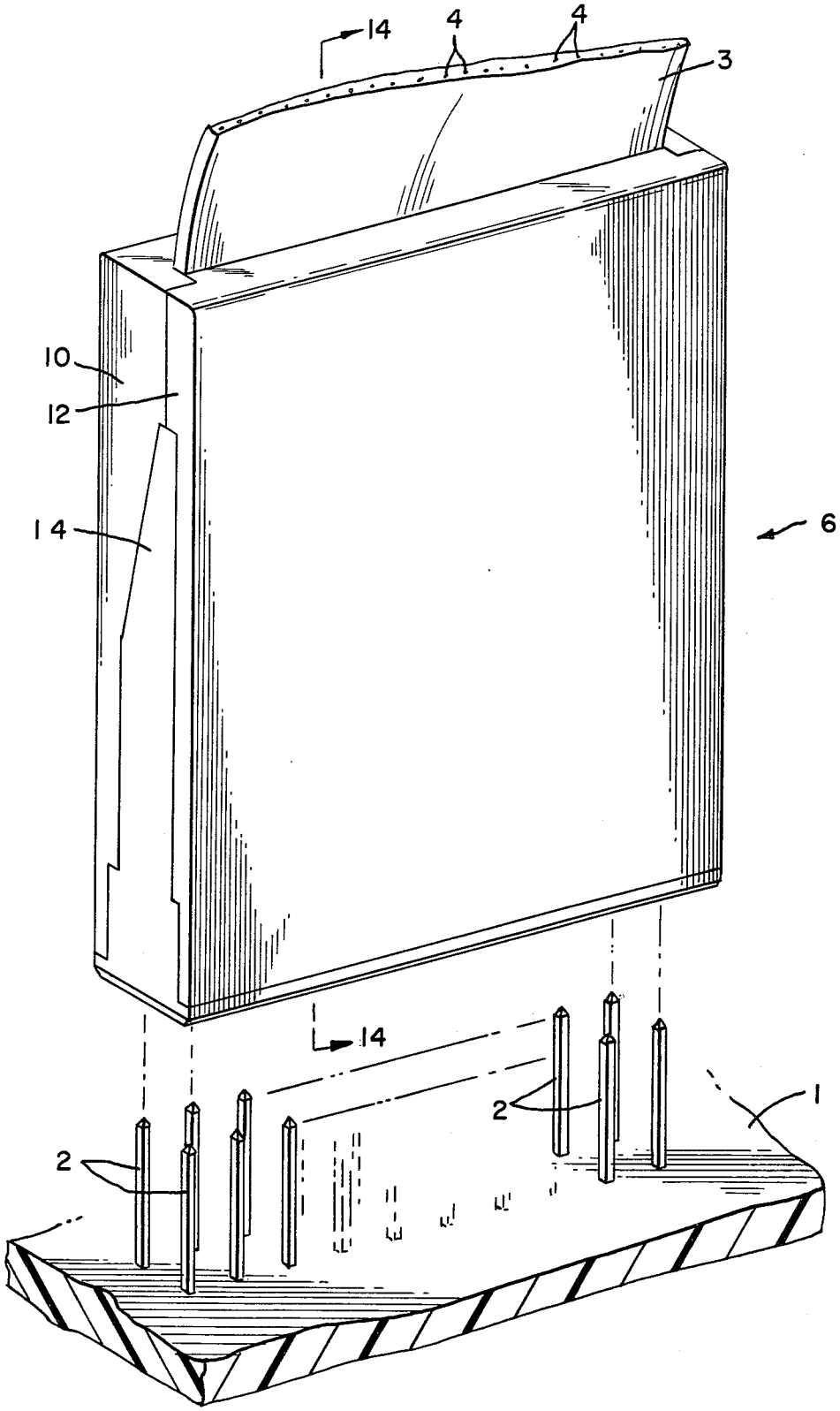
FIG. 1 is a connector assembly prior to mounting a substrate having upstanding posts.

FIG. 1 illustrates the connector of the preferred embodiment as terminated to a ribbon cable and positioned for attachment to a panel board or substrate 1. Substrate 1 has a plurality of terminal posts 2 aranged in a rectangular pattern with a centerline spacing of 0.125 in. Ribbon cable 3 has a plurality of conductors 4, both ground and signal, with a centerline spacing of 0.03 in. which have been terminated in connector assembly 6 to produce an assembly having a centerline spacing of 0.125 in.

Figure 2:
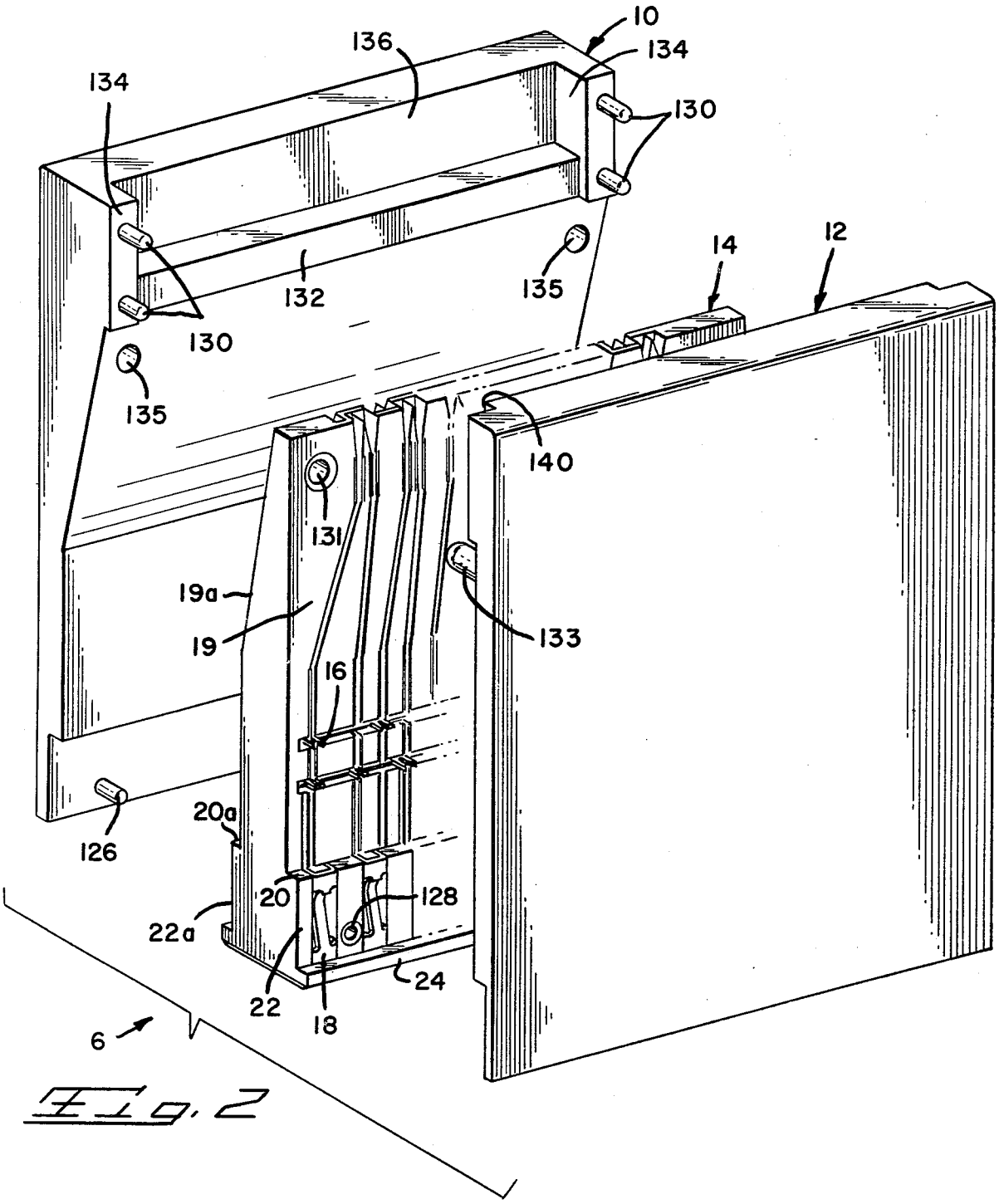
FIG. 2 is an exploded view of the connector shown in FIG. 1.

The connector assembly 6 is shown in FIG. 2 in an exploded view. The connector assembly comprises a first cover 10, a dielectric body 14, and a second cover 12. Body 14 will be discussed first as it is the essential workpiece of the connector assembly 6.

Figure 3:
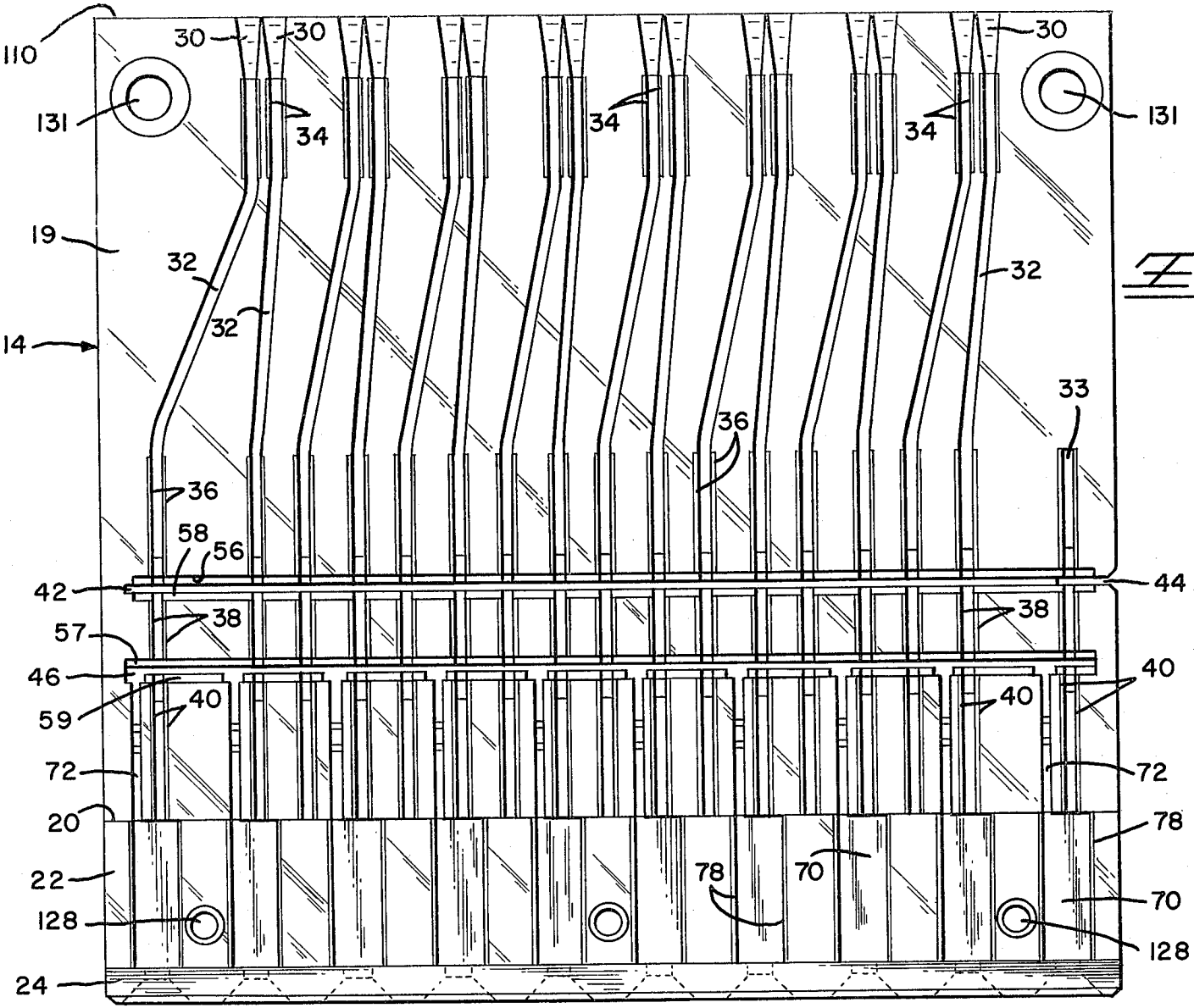
FIG. 3 is a plan view of connector body without terminals.

FIG. 3 is a plane view of one sidewall 19 of connector body 14. The oppositely facing sidewalls 19 and 19*a* of body 14 have essentially identical features so that the foregoing description will generally apply to both surfaces. Sidewall 19 extends from conductor receiving end 110 of body 14 to mating end 24. A plateau 20 perpendicular to sidewall 19 defines a raised lateral surface 22 on sidewall 19 adjacent to mating end 24.

Figure 4:
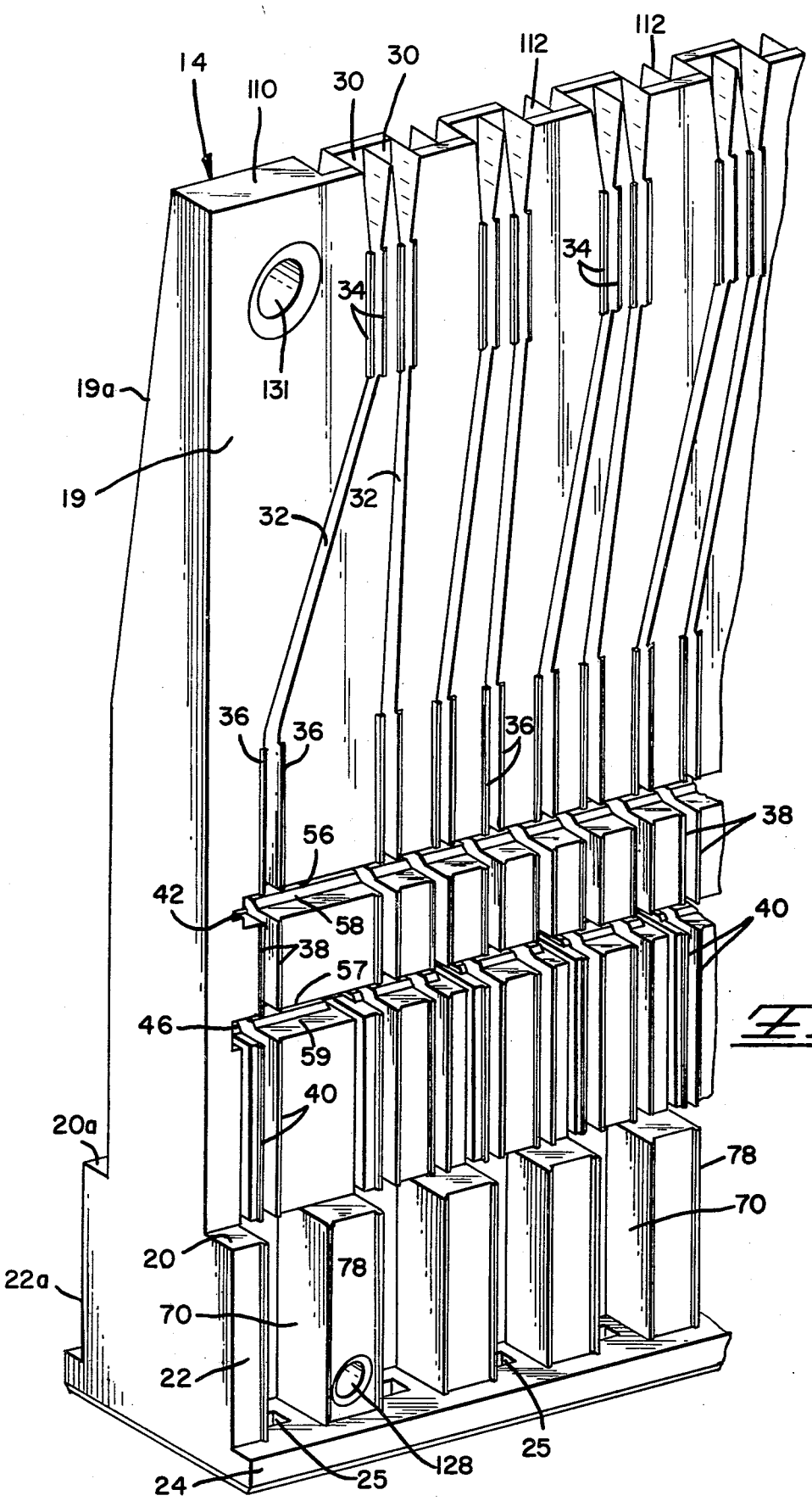
FIG. 4 is a fragmentary perspective view of connector body without terminals.

Referring to FIGS. 3 and 4, across the uppermost portion of sidewall 19 there are a plurality of funnel entries 30 in end 110 which communicate with an equal number of conductor guide grooves 32. Each guide groove 32 extends down sidewall 19 to plateau 20, and intersects channels 42 and 46, which channels form part of the terminal receiving cavities. A plurality of paired parallel ribs 34, 36, 38 and 40 which protrude by approximately 0.002 in. from sidewall 19 are positioned immediately adjacent each guide groove 32. These ribs will be explained more fully hereinafter. Note that groove 33 on sidewall 19 does not extend the full distance of the guide grooves 32 and does not have a funnelentry communicating therewith. In the preferred embodiment conductor groove 33 is fitted with a jump lead which connects ground bus 16 with terminal 18.

Channel 42 extends across lateral surface 19 perpendicular to the conductor grooves 32 and terminates at conductor groove 33. Recess 44 is formed in body 14 to a depth just beyond conductor groove 33 and immediate to channel 42. It should be remembered that a channel 42 exists on lateral surface 19*a* . Thus, recess 44 permits a generally "U" shaped ground bus 16, as shown in FIG. 6, to be snuggly slid into the channel 42 thereby creating a common ground bus 16 for the entire connector. Bus 16 of FIG. 6 is exemplary and other configurations or combinations of ground-signal distribution are possible. A second channel 46 parallel to channel 42 and perpendicular to all the grooves 32 and 33 on lateral surface 19 is designed to receive the conductor termination portion of signal terminal 18 and will be explained more fully with reference to FIG. 5.

Figure 5:
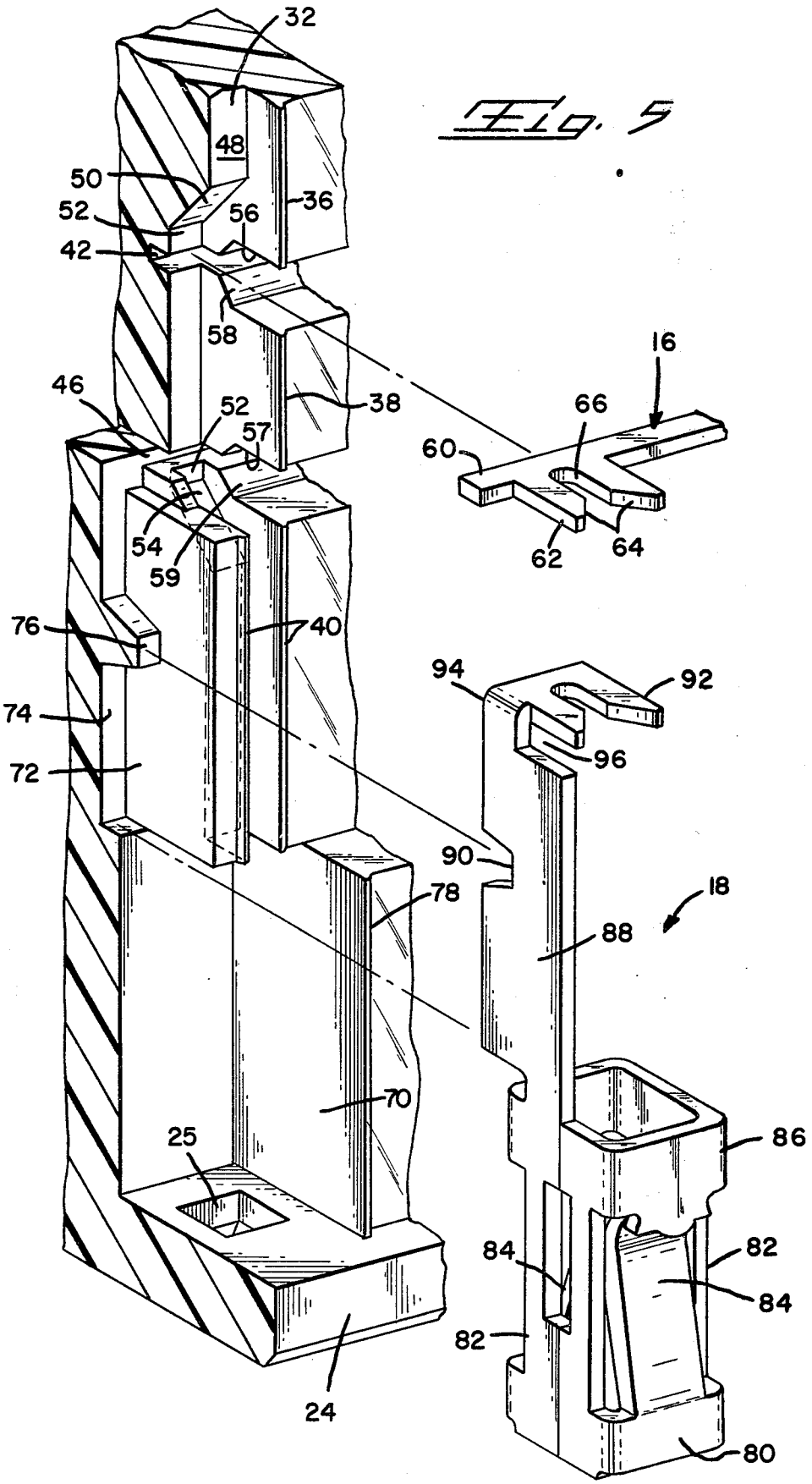
FIG.5 is a fragmentary perspective view of a single conductor path with terminals exploded out.
Figure 6:
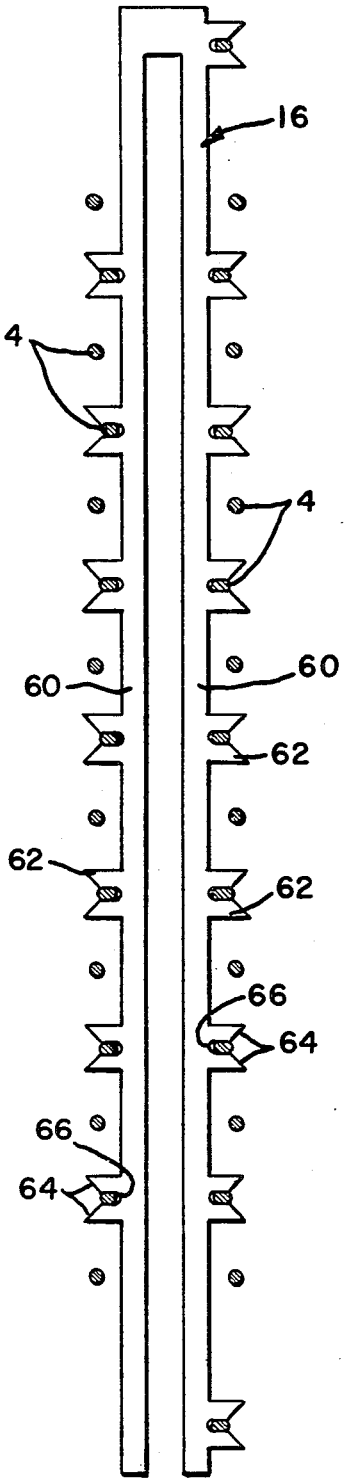
FIG. 6 is a diagrammatic view of the bus strip and conductors located in a connector body.

Referring now to FIG. 5, there is shown an exploded fragmentary perspective of a conductor guide groove and termination area. Conductor groove 32 has a depth of approximately 0.015 in., which is slightly greater than the diameter of a 28 gauge conductor, and a width approximately equal to the diameter of the conductor to achieve a snug conductor fit. Conductor groove 32 is recessed in the conductor termination area to permit easier conductor termination. Inwardly sloped surface 50 extends from the floor 48 of conductor groove 32 to sub-floor 52, which is parallel to floor 48 and extends from a point above channel 42 to a point below second channel 46. Outwardly sloped surface 54 extends from sub-floor 52 to floor 48.

Channel 42 forms a row of ground terminal-receiving cavities and has sufficient depth below sub-floor 52 to accept substantially all of bar 60 of ground bus 16. This locates each ground terminal or slotted plate 62 of ground bus 16 perpendicular to a conductor guide groove 32 but inside the plane of sidewall 19. The conductor receiving portion of slotted plate 62 is composed of an open "VEE" lead-in 64 which communicates with "U" shaped slot 66. The respective arms of the "VEE" lead-in 64 progress from points outside the width of conductor groove 32 inward to the open end of "U" shaped slot 66 which lies within the width of conductor groove 32. Slot 66 has a width less than the diameter of the conductor. Thus, slotted plate 62 will be deflected outwardly as a conductor is inserted therein to achieve an interference fit. Channel 42 is enlarged at parallel channel surfaces 56 and 58 to provide clearance above and below slotted plate 62.

Referring still to FIG. 5, the signal terminal-receiving cavities of body 14 are comprised of a plurality of box-like cavities 70, a plurality of parallel grooves 72, common channel 46, and parallel channel surfaces 57 and 59. Passageway 25 is dimensioned to permit a terminal post 2 (FIG. 1) to pass through mating end 24 into box-like cavity 70. Cavity 70 has a depth referenced from surface 22 of approximately 0.060 in., a width of approximately 0.040 in., and a height of approximately 0.160 in. Groove 72 extends from cavity 70 to channel 46 and is formed to a depth beyond cavity 70 such that rear wall 74 lies in the same plane as the deepest portion of channel 46. Key 76 is integral with rear wall 74 and serves to locate the terminal 18 within the signal terminal area. Parallel ribs 78 protrude from surface 22 adjacent to cavity 70 and are used to retain the terminal 18 in cavity 70 as will be explained hereinafter.

Terminal 18 is stamped and formed beryllium copper and has base 80, sidewalls 82 which are integral with base 80 and crown 86, cantilever arms 84 which are integral with and deflected inwardly from base 80, upstanding arm 88 which is integral with crown 86, and slotted plate 92 which is integral with and generally perpendicular to arm 88. The lower portion of terminal 18 up to and including crown 86 is dimensioned to be received in cavity 70. This is intended to be a snug fit and interference fit is not required. Upstanding arm 88 is received in groove 72 while keyway 90 is dimensioned to be received by key 76. The position of keyway 90 in upstanding arm 88 will determine the vertical location of slotted plate 92 in channel 42 and its position in conductor guide groove 32. Slotted plate 92 is essentially the same geometry as slotted plate 62. Section 96 of upstanding arm 88 has been removed to form a bending stress relief for right angle bend 94 and to assure the spring quality of slotted plate 92. Channel surfaces 57 and 59 provide clearance above and below slotted plate 92.

Figure 5A:
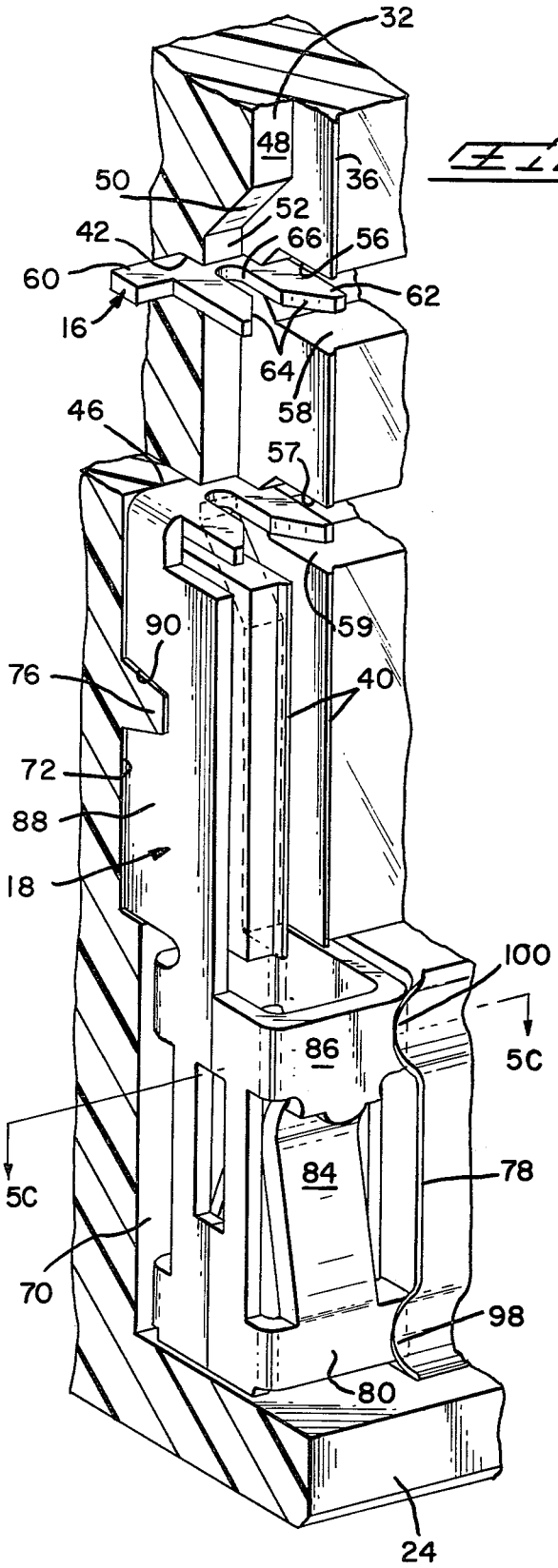
FIG. 5A is a fragmentary perspective view of a single conductor path with terminal inserted.
Figure 5B:
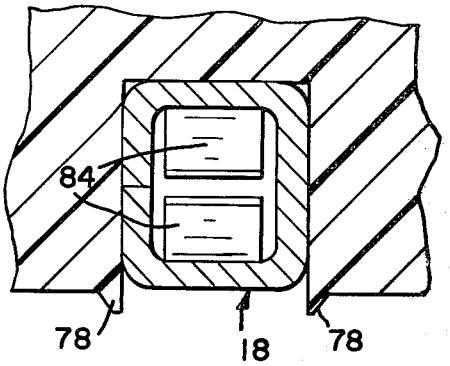
FIG. 5B is a sectional fragmentary view of a terminal cavity prior to striking of terminal securing means.
Figure 5C:
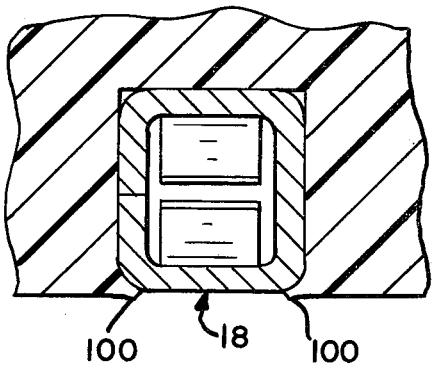
FIG. 5C is a sectional fragmentary view of a terminal cavity after striking of terminal securing means.

FIG. 5A shows ground bus 16 and terminal 18 located in their respective positions. Ground bus 16 is retained in position as by its shape and does not require additional holding means. After all the terminals 18 have been located in cavities 70 of body 14, the ribs 78 are struck with appropriate tooling adjacent base 80 and crown 86 to produce material flow as indicated at 98 and 100. The material provided via ribs 78 assures sufficient material flow to retain the terminal 18 as shown in FIGS. 5B and C.

Returning again to FIG. 4, there are shown the funnel entries 30, which in the preferred embodiment are generally arranged so that alternate pairs are directed to the same sidewall. Each funnel entry has a depth on conductor receiving end 110 of approximately two-thirds the width of conductor receiving end 110. Between funnel entries there is a chisel tip 112 which lies generally in the plane of upper surface 110. From FIG. 4A, it is clear that a conductor receiving portion of each entry extends along a straight path or centerline drawn through the length of end 110. Directing surfaces 114, 116 and 118 extend between end 110 and conductor groove 32. Directing surface 114 has an angle of approximately 15° and directing surfaces 116 and 118 have angles of approximately 7°. The meeting of directing surfaces 116 and 118 produce the chisel tip 112. From the foregoing, it can be seen that conductors presented over the centerline of the body 14 and moved toward the body will be directed toward a sidewall by directing surface 114 and further aligned with conductor groove 32 by directing surfaces 116 and 118.

Figure 7:
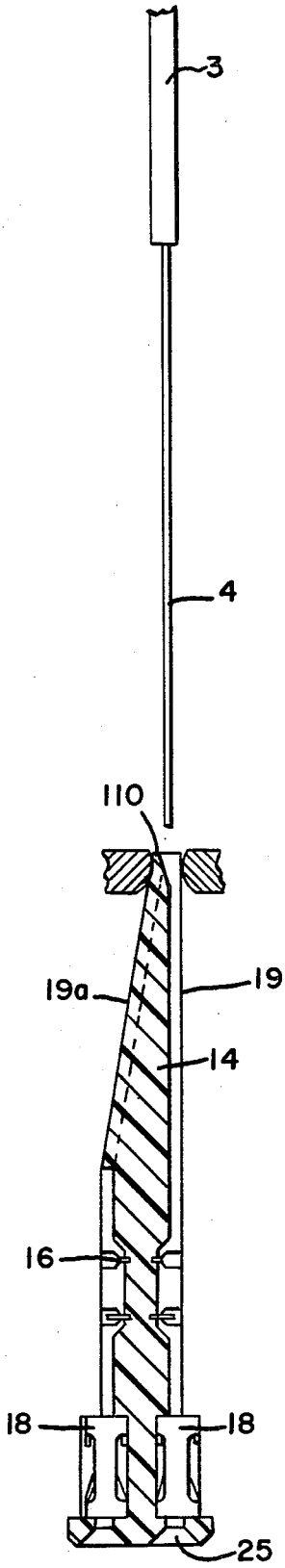
FIG. 7 is a side sectional view of the connector with conductor cable positioned above centerline.
Figure 15:
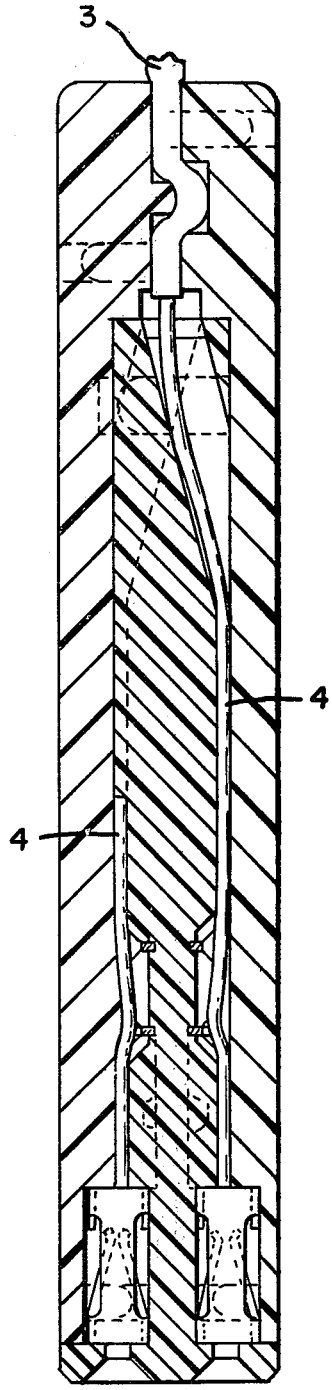
FIG. 15 is a side sectional view as in FIG. 14 for a connnector body having a square configuration.
Figure 8:
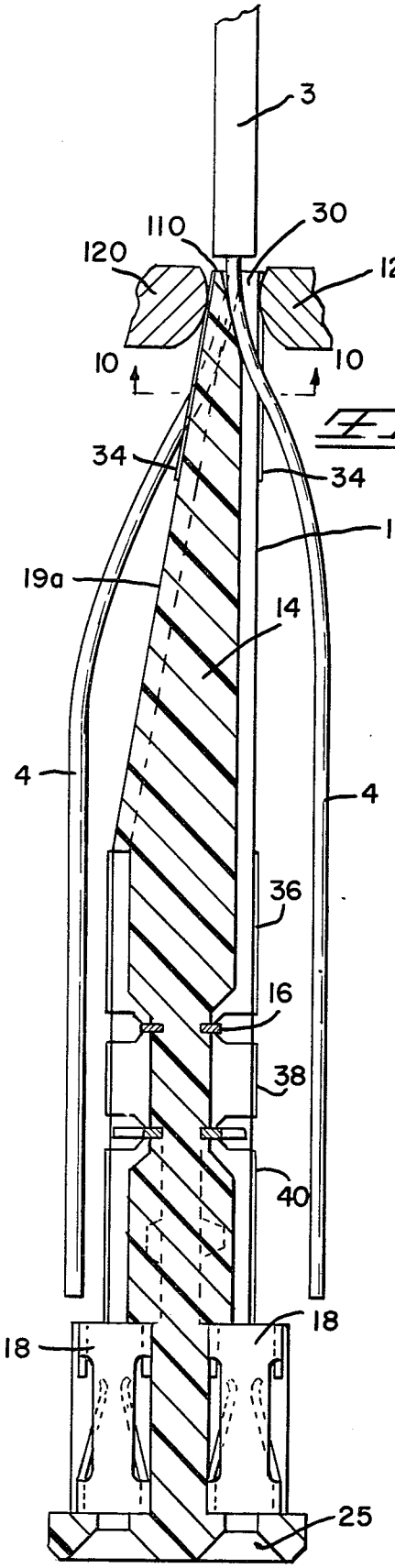
FIG. 8 is a side sectional view of the connector body with conductors in a pre-wiping position.
Figure 9:
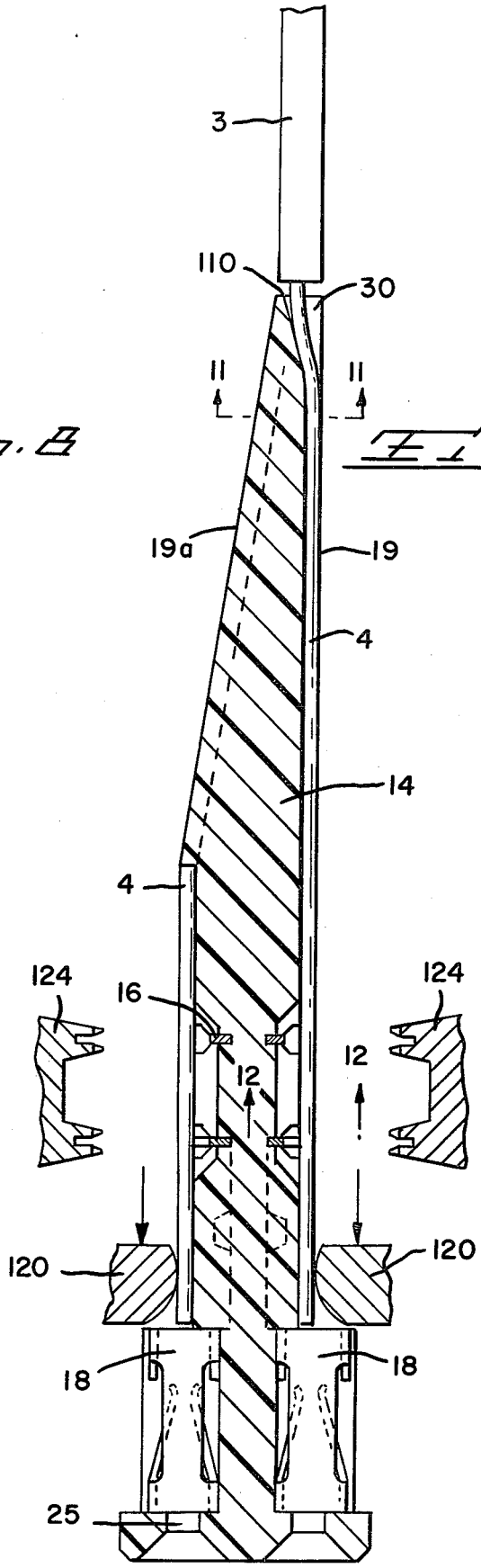
FIG. 9 is the connector of FIG. 8 with conductors wiped prior to termination.
Figure 10:
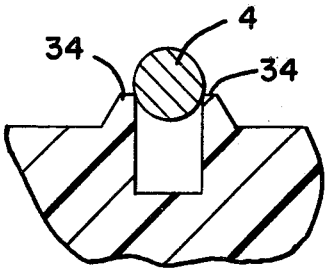
FIG. 10 is a fragmentary section of the conductor securing means before wiping, taken along the lines 10—10 of FIG. 8.
Figure 11:
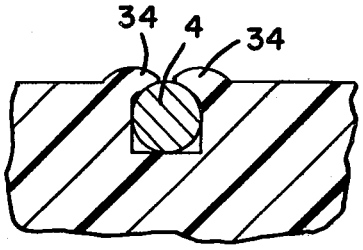
FIG. 11 is a fragmentary section of the conductor securing means after wiping, taken along the lines 11—11 of FIG. 8.

Referring now to FIGS. 7, 8 and 9, there is shown a sectional view of a cable as presented to and ultimately terminated in the body 14. The cable 3 with conductors 4 cut and stripped is moved toward body 14 over the funnel entries 30, FIG. 7. As the conductors are moved into the funnel entries they are directed over respective sidewalls 19 and **19*a*, FIG. 8. Wiper members 120 are then moved down the sidewalls, FIG. 9. The wiper members are maintained in contact with the body so as to form a moving fourth side to the grooves 32 as the wiping members progress down the sidewalls 19 and 19*a*. The combination of the wiping motion and the control established through the funnel entries 30 establish the conductors in the grooves as the wipers progress. The conductors are retained securely in the guide grooves 32 through the deformation of the parallel ribs 34, 36, 38 and 40, FIG. 4. The pressure applied by the wiping members 120 as they retain contact with body 14 is sufficient to cause a material flow of the ribs over the conductors. This can be clearly seen in FIGS. 10 and 11, where the ribs protruding from the lateral surface are moved over the groove 32** behind the conductor as the wipers progress and form a retaining means for the conductors.

Figure 12:
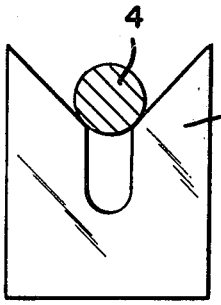
FIG. 12 is a conductor located at slotted terminal prior to termination.
Figure 13:
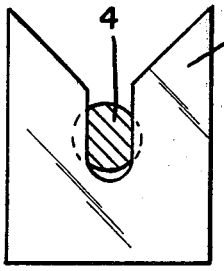
FIG. 13 is a conductor terminated in slotted terminal.

Returning to FIG. 9, there is shown a termination tool 124 which is suitable to terminate the conductors after the fully wiping action pushing the conductors into the slotted plates 62 and 92. It should be remembered that the conductors snuggly fitted into grooves 32 and that the slight conductor movement necessary to accomplish termination may be achieved without dislocation of the conductor from its respective conductor groove. FIG. 12 and FIG. 13 are graphic representations of the above termination. In FIG. 12, the conductor has been wiped into the groove 32 which presents the conductor to the lead-in 64 of the slotted plate. In FIG. 13, the conductor has been moved into the slot 66. Since the slot 66 is less than the core diameter of the conductor, some conductor deformation takes plate and an interference fit is achieved.

Returning to FIG. 2, it can be seen that the covers 10 and 12 are contoured to compliment sidewalls 19 and **19*a* and are assembled to body 14 to produce a connector having the area of mating end 24. Thus, the covers when assembled do not add to the usage of area on the substrate. The covers are secured to body 14 via posts 126 which are mated with complimentary cavities 128 spaced along raised lateral surfaces 22 and 22*a* and posts 130 which are similarly received in complimentary cavities in cover 12. Posts 133 of cover 10 pass through the openings 131 in body 14 and are received in the complimentary cavities 135 of cover 12**.

Figure 14:
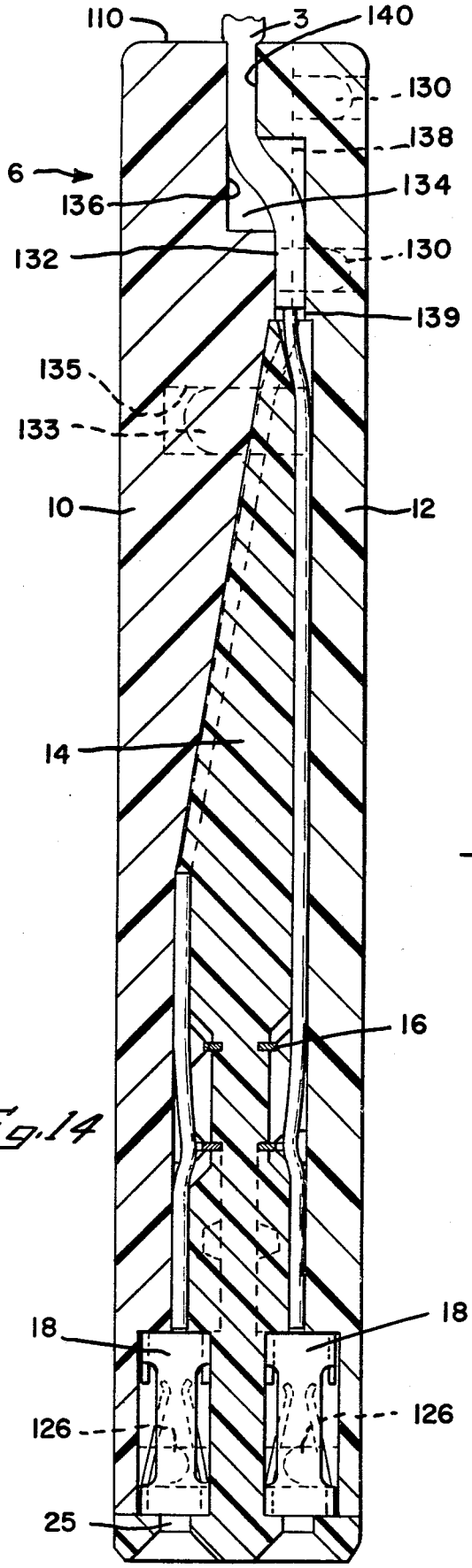
FIG. 14 is a side sectional view of terminated connector assembly with covers, taken along the lines 14—14 of FIG. 1.

The covers also perform a strain relief function which is most easily seen by reference to FIGS. 2 and 14. The cover 10 has a rail 132 which extends over conductor receiving end 110 to approximately the centerline of end 110. Sidewalls 134 extend slightly beyond rail 132 and provide side capture means to further confine the cable therein. Rear wall 136 is recessed slightly from the plane of surface 110. Cover 12 has sidewalls 138 which extend approximately halfway over surface 110 and compliment the sidewalls 134 of cover 10 to completely capture the ribbon cable therein. The complimentary cavities for posts 130 are located in sidewalls 138. A ridge 139 extends slightly over end 110 and directly opposite rail 132. Ridge 139 and rail 132, therefore, define a cavity substantially equal in cross-section to the cable area. Rail 140 of cover 12 is inside sidewall 138 and extends over the major portion of surface 110 and is directly opposed to rear wall 136. Thus, as seen in FIG. 14, the covers when assembled produce a modified "S" strain relief in the cable 3.

Note in FIG. 14 that sidewall **19*a* of body 14 has been sloped inwardly at the upper portion thereof because it is believed that the additional material gained in cover 12 provides strength to the strain relief member facilitates the mating of posts 133 and cavities 135. The sloping of lateral surface 19*a* does not alter the features of the connector as described herein and as shown in the alternative embodiment of FIG. 14**, where the connector is provided with parallel sidewalls.

FIG. 16 shows an alternate embodiment of the present invention which incorporates a fourth side 142 to the funnel entry 30. The inclusion of a fourth side 142 provides an additional control over the conductors, as directed to opposite sides of the body 14, which may be desirable in certain applications.

Figure 17:
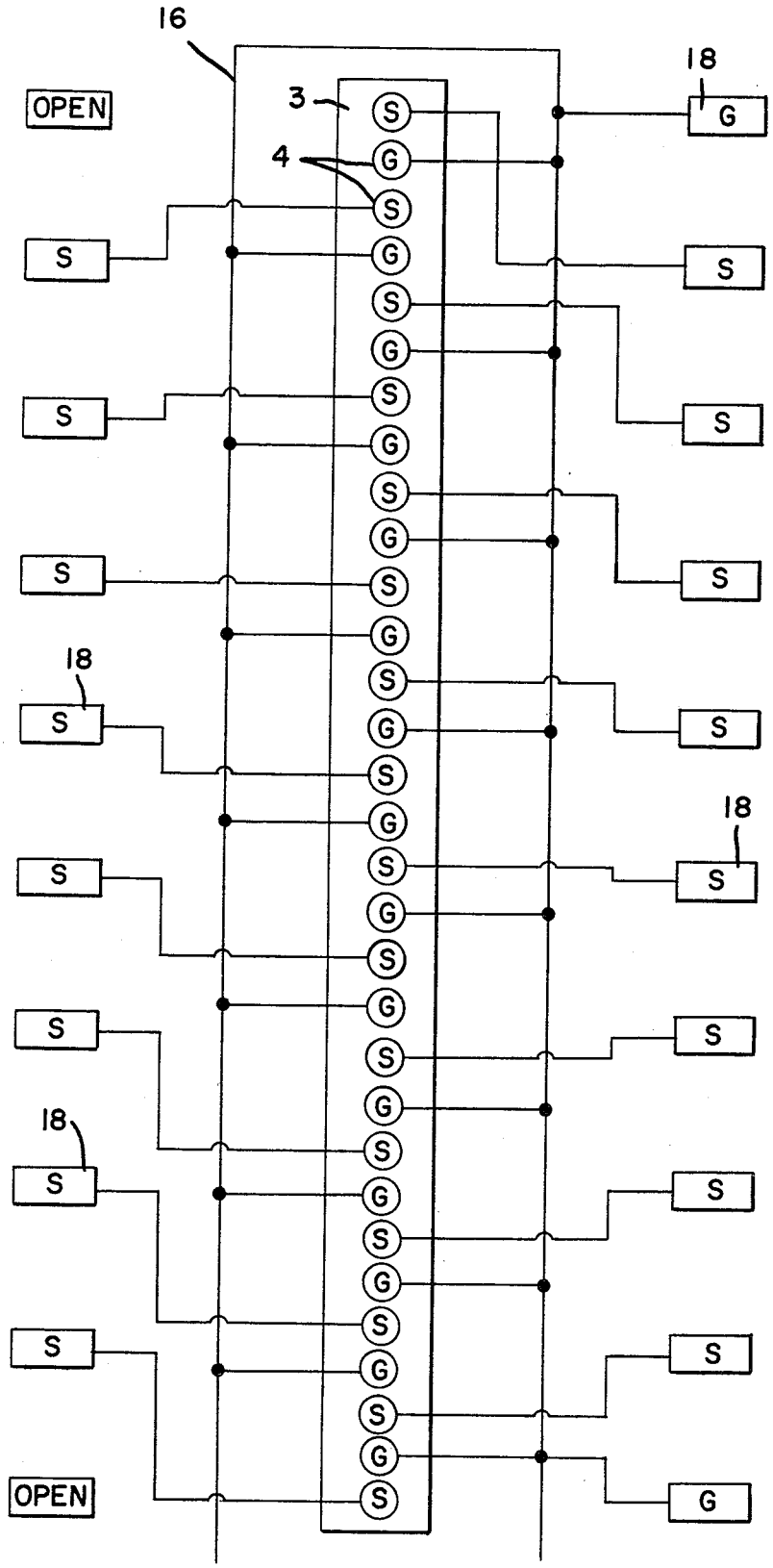
FIG. 17 is a diagram of conductors as redistributed by connector according to the teachings of the present invention.

FIG. 17 is a diagrammatic view of a 31 conductor ribbon cable which has the conductors distributed and terminated in a connector according to the instant invention. Each of the sixteen (16) signal conductors has been terminated to an electrically insulated signal terminal according to a predetermined pattern. The remaining fifteen (15) ground conductors have been commoned via the ground bus and the entire grounding arrangement has been terminated to the side terminals in sidewall 19 which correspond to the G's on the right side of the diagram. FIG. 17 is exemplary and not exhaustive.

Although preferred embodiments of the present invention are disclosed and shown in detail, other modifications and embodiments which would be apparent to one having ordinary skill in the art, are intended to be covered by the spirit and scope of the claims.

We claim:

1. A multi-contact electrical connector of the type having two rows of electrical contact terminals and intended to be installed on the end portion of a flat multi-conductor cable, said connector comprising a dielectric body having a conductor receiving end, a mating end, and oppositely facing first and second sidewalls extending from said conductor receiving end to said mating end, the improvement comprising:

a plurality of terminal receiving cavities in said oppositely directed sidewalls, each said cavity having one of said terminals therein, a plurality of entries in said conductor receiving end, some of said entries communicating with said first sidewall and other of said entries communicating with said second sidewalls, all entries having a conductor receiving portion which lies along a common straight line extending the length of the conductor receiving end of the dielectric body, said straight line defining the center line of a straight path, said path having a greater width than the thickness of said conductors, whereby said conductors can be moved into the entries in a coplanar array, a plurality of guide grooves in said oppositely directed sidewalls, each said guide groove communicating between one of said entries and one of said terminal receiving cavities, whereby, upon moving each conductor in said multi-conductor cable into one of said entries some of said conductors will be biased to said first sidewall and other of said conductors will be biased to said second sidewall, and upon aligning said conductors into said conductor guide grooves, each said conductor will communicate with a terminal receiving cavity for termination to an electrical terminal therein.

2. The connector of claim 1, wherein some of said entries communicate with grooves in said first sidewall in pairs of side by side entries, and other of said conductors communicate with said second sidewall in alternating pairs of side by side entries.

3. The connector of claim 1 wherein each entry has a rearwall on the opposite side of the entry from the sidewall with which the entry communicates, said rearwalls of said entries which commnicate with said first sidewall lying in a first plane of said rearwalls of said entries which communicate with said second sidewall lying in a second plane, said first and second planes intersecting the conductor receiving end of the dielectric body in respective parallel first and second straight lines, said straight lines forming the lateral boundaries of said straight path.

4. The connector of claim 3 wherein said rearwall of each said entry is canted from its intersection with the conductor receiving end toward the sidewall with which the respective entry communicates.

5. The connector of claim 4, wherein each entry has opposed endwalls extending from said rearwall to the sidewalls with which the entry communicates, said endwalls being canted toward each other from their intersections with said mating end, said rearwall and said endwalls of each said entry converging to meet said conductor guide groove with which said entry communicates, whereby the movement of the array of conductors into the entries causes them to be easily biased to the respective surfaces with which the entries communicate.

* * * * *